US005370386A

United States Patent [19]

Parks

[11] Patent Number: 5,370,386

[45] Date of Patent: Dec. 6, 1994

[54] SPORTS TRAINING TARGET AND METHOD

[76] Inventor: Alan D. Parks, 1351 Charlotte St., Altamonte Springs, Fla. 32701

[21] Appl. No.: 57,047

[22] Filed: Apr. 30, 1993

[51] Int. Cl.[5] ..... A63B 69/40

[52] U.S. Cl. ..... 273/26 A; 273/57.2; 273/400

[58] Field of Search ..... 273/26 R, 26 A, 57.2, 273/348, 398, 400, 401, 402

[56] References Cited

U.S. PATENT DOCUMENTS

| | | | |
|---|---|---|---|
| 2,873,969 | 2/1959 | Ziel | 273/26 A |
| 2,988,360 | 6/1961 | Lambiotte | 273/26 A X |
| 3,197,208 | 7/1965 | Makar | 273/400 X |
| 3,312,467 | 4/1967 | Dawson | 273/26 A |
| 4,173,337 | 11/1979 | Okonowski | 273/26 A |
| 4,210,326 | 7/1980 | Booth et al. | 273/26 A |
| 4,254,952 | 3/1981 | Plater, Jr. | 273/26 A |
| 4,497,485 | 2/1985 | Macosko | 273/26 A |
| 4,781,376 | 11/1988 | Barnes, Sr. | 273/26 A |
| 4,842,283 | 6/1989 | Lebel et al. | 273/26 A X |
| 5,064,194 | 11/1991 | Bixler et al. | 273/26 A |

*Primary Examiner*—William H. Grieb

[57] ABSTRACT

A sports training target useful in developing accuracy and technique in delivering a projectile such as a baseball or hockey puck is provided. A series of nested and adjustable shutters are formed about a frame so as to protect the frame and absorb the energy of the projectile and eliminate concern from the player of being hit by a rebounded projectile thus allowing the player to concentrate on the training objectives. A target opening includes elements to establish a target for a particular drill. By way of example, the elements can be arranged for pitching to the target at shortened distances compared to the standard mound to plate distance. The target elements are then arranged to compensate for a side arm or other styled pitcher. With the combination of element placement within the target opening and the energy absorbent characteristics of the target, training takes place in confined areas without concern for the safety of the pitcher because of rebounded balls. Batting drills close to the target are also safely made using the shutters as targets because of the high absorption characteristics of the shutter material and target construction.

27 Claims, 10 Drawing Sheets

50
504
502

562

564

50
52
54

566

58
60
10
12
38
36
50
44
42
62
46
30
18
32
34
26
40
28
16
48

SPORTS TRAINING TARGET AND METHOD

BACKGROUND OF THE INVENTION

1. Field of Invention

This invention relates to sports training devices and in particular to a target for developing accuracy and technique of a player delivering a projectile such as a baseball or hockey puck to a preferred location.

2. Background of Related Art

A variety of targeting devices have been developed to aid a player in developing accuracy in pitching, hitting or delivering a projectile such as a baseball, golf ball or hockey puck to a specific location. Often times, a teammate assists in the practice procedures associated with improving the player's skill. For example, a catcher would work with a pitcher in an effort to perfect accuracy in delivering a given pitch to a particular point within or outside a designated strike zone. To eliminate the need for added personnel and man-hours, practice devices have been developed that provide a target for the pitcher to use without the need for added personnel.

U.S. Pat. No. 4,210,326 issued on Jul. 1, 1980 to John A. Booth et al. discloses a portable target apparatus including a variable sized opening for a baseball pitcher and includes a net comprising a stop for the balls which are pitched through the selectively variable target area. The size of the target opening area can be varied by horizontally and vertically movable straps which are mounted on the target frame structure.

It is well known in the art to employ various baseball pitching practice devices formed of frame structure with target elements defining a strike zone. U.S. Pat. No. 4,254,952 issued on Mar. 10, 1981 to George H. Player, Jr. discloses a pitching practice device consisting of a sheet of canvas having an opening defining a strike zone. To better define accuracy, a plurality of chutes that catch the balls thrown is attached to the rear of the opening for receiving and trapping any ball entering the opening of the given chute. In this way, accuracy can be recorded. The canvas sheet is resiliently supported to prevent damage either to the device or to the ball.

U.S. Pat. No. 4,173,337 issued on Nov. 6, 1979 to Richard L. Okonowski discloses a baseball batting and pitching apparatus. A strike zone area is enclosed on three sides and open on one side to allow baseballs to be thrown in to the strike zone area for practice. An image of a batter is supported over a batter's box area to better simulate pitching conditions. A plurality of pads are used to define the strike zone.

Although the art may appear to have a number of such target devices as above described, the full range of problems associated with such devices has not been fully developed to the point where such target devices can be effectively used especially in the professional sports where the greatest demands are placed. For example, at baseball pitching speeds reaching and exceeding one hundred miles an hour, a tremendous amount of energy is being delivered to the target. If the opening defining the strike zone is missed, the target can be damaged especially after the many hits by a projectile such as a baseball. The same is true of a hockey puck. In addition, with speeds as described there is a constant threat that the ball or projectile will be reflected back at the player possibly causing injury and certainly causing such a distraction so as to take away from an effective skills training session. And since practice sessions are at times held indoors because of weather conditions, a training device that can be safely applied to close range and/or indoor use in developing accuracy and measuring progress of the development has not been found in the art and is needed.

SUMMARY OF INVENTION

The present invention relates to a sports target and method for safely developing accuracy and technique of a player delivering a projectile such as a baseball or a hockey puck. A frame defines an opening wherein shutter means are fitted with the frame for permitting adjustments to a dimension of the opening. A plurality of resilient elements supported by the frame extend into the opening. The target further comprises means for adjusting the extension of the resilient elements into the opening and comprises elements that include means for generating a signal responsive to a striking of the corresponding element with a sports projectile. In one embodiment, each element comprises a flap supported by the frame along only one side thereof, and means for rotation about that side.

In another embodiment, a sports target for receiving a projectile thrown or hit by a player comprises a frame having an opening and an adjustable shutter means mounted in spaced relation with the frame in a direction toward the player. The adjustable shutter means permits an adjustment to a dimension of the opening and further includes means for protecting the frame from damage through impact with the projectile.

In the preferred embodiment of the invention, the sports target comprises a frame, a first shutter movably supported in spaced relation from the frame in a direction toward the player, the first shutter forming a shield across a first portion of the frame, a second shutter movably supported in spaced relation from the frame in a direction toward the player, the second shutter forming a shield across a second portion of the frame, a first upper shutter supported in spaced relation from the frame in a direction toward the player, the first upper shutter forming a shield across a third portion of the frame, a second upper shutter supported by the frame, the second upper shutter in spaced relation to the first upper shutter, a first lower shutter supported in spaced relation from the frame in a direction toward the player, the first lower shutter forming a shield across a forth portion of the frame, and a second lower shutter supported by the frame, the second lower shutter in spaced relation to the first lower shutter, wherein the shutters together totally shield the frame, and together form an opening through which the projectile can pass. In an alternate arrangement to this preferred embodiment, a multiplicity of first shutters are movable supported in spaced relation to the frame in a direction toward the player, at least one first shutter forming a shield across a first portion of the frame, and a multiplicity of second shutters are movable supported in spaced relation to the frame in the direction of the player, at least one second shutter forming a shield across a second portion of the frame. A multiplicity of second upper shutters are supported by the frame, each second upper shutter in spaced relation to each other and to the first upper shutter, and a multiplicity of second lower shutters are supported by the frame, each second lower shutter in spaced relation to each other and to the first lower shutter, wherein the multiplicity of shutters together form the opening through which the projectile can pass.

The preferred embodiment of the sports target further comprises a plurality of target elements rotatably affixed to the frame, wherein each element extends from the frame at least partially into the opening formed by the shutters. The target elements further comprise means for removably affixing target markers to the element.

A method is provided for safely developing accuracy and technique in a player delivering a sports projectile to a preferred target location. The method comprises the steps of providing a frame having an upper support member and a base support member, separating the support members from a first slide rail and a second slide rail, thereby forming a frame opening with the slide rails and members, movably supporting a first shutter in spaced relation to the upper support member in the direction of the player, forming a shield with the first shutter across the first slide rail, movably supporting a second shutter in spaced relation to the upper support member in the direction of the player, forming a shield with the second shutter across the second slide rail, supporting a first upper shutter in spaced relation to the upper support member in the direction of the player, forming a shield with the first upper shutter across the upper support member, movably attaching a second upper shutter to the slide rails, the second upper shutter in spaced relation to the first upper shutter, communicating the second upper shutter with the first upper shutter for expanding a surface area formed by the upper shutters, supporting a first lower shutter in spaced relation to the base support member in the direction of the player, forming a shield with the first lower shutter across the base support member, and movably attaching a second lower shutter to the slide rails, the second lower shutter in spaced relation to the first lower shutter, communicating the second lower shutter with the first lower shutter for expanding a surface area formed by the lower shutters, forming the upper and lower shutters and the first and second shutters together into an opening within the frame opening through which the trajectory can pass. In alternate embodiments, a multiplicity of shutters are provided.

A preferred method further comprises the steps of providing a plurality of target elements, rotatably affixing the target elements to the frame, and extending each element from the frame at least partially into the opening formed by the shutters. Target markers are removably affixed to the elements. Means are provided for collecting the projectile once it has passed through the opening. The target is relocated from position to position to accommodate the training drill of choice.

It is an objective of the invention to provide a training target that can be safely used by a player. The target absorbs the energy of the oncoming projectile eliminating concern by the player that he or she may be hit by a deflected projectile. It is another objective of the invention to provide a target that can withstand the multiplicity of hits that the target takes by the projectile without damage to the target. It is also an objective of the invention to provide the player with a target that can be adapted to the training conditions that may differ from actual playing conditions yet simulate the actual conditions so as to provide effective training in developing accuracy and techniques.

BRIEF DESCRIPTION OF DRAWINGS

A preferred embodiment of the invention as well as alternate embodiments are described by way of example with reference to the accompanying drawings in which:

FIG. 3 is a partial perspective view of target elements extending into the opening of the target frame;

DETAILED DESCRIPTION

Preferred Embodiment

Figure 1:
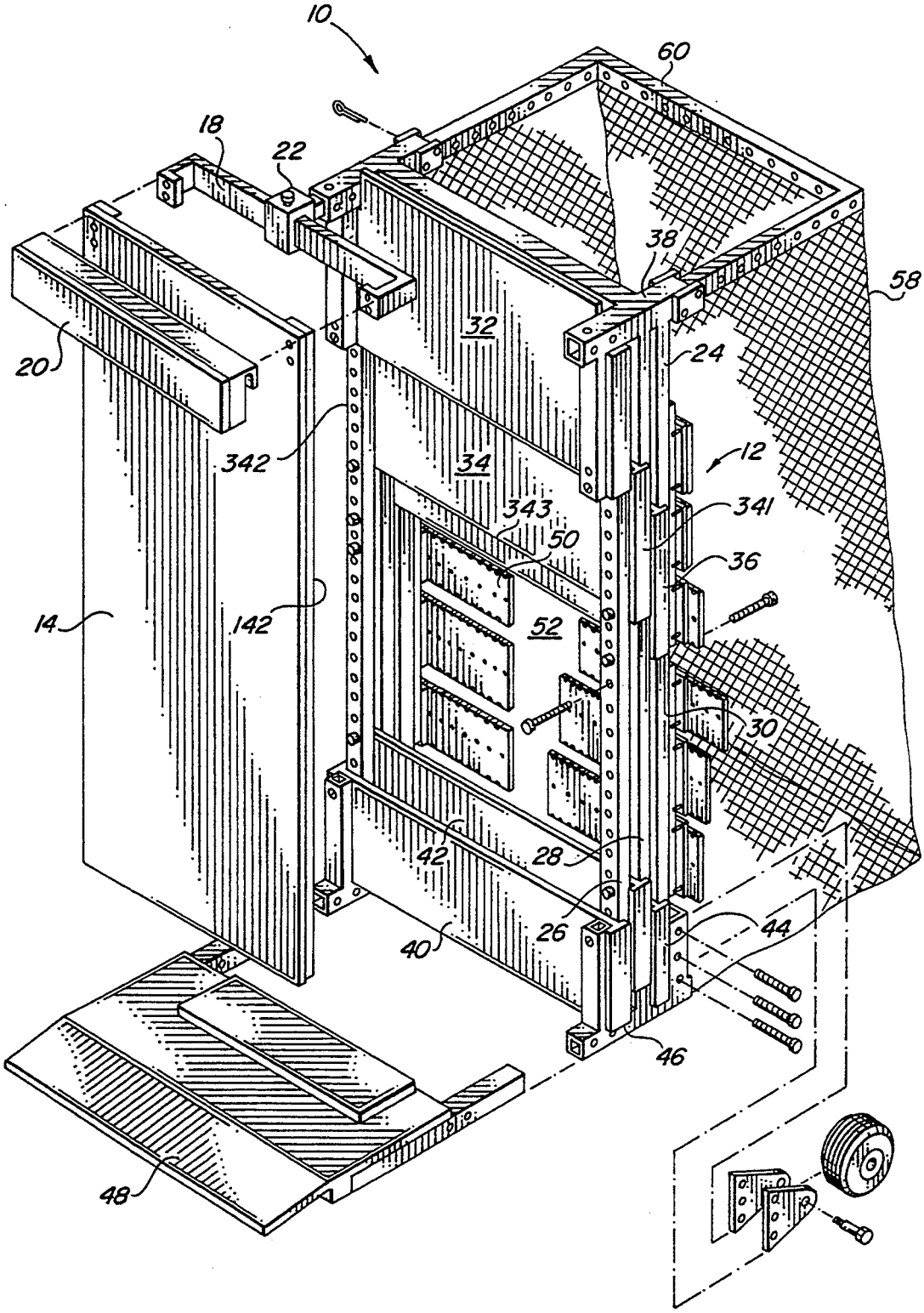
FIG. 1 is a partial exploded perspective view of the preferred embodiment of the invention, a sports target useful in safely developing accuracy and technique in a player delivering a projectile such as a baseball or hockey puck to a preferred and measurable location.
Figures 2, 3A, 3B, 3C, 3D, 3E:
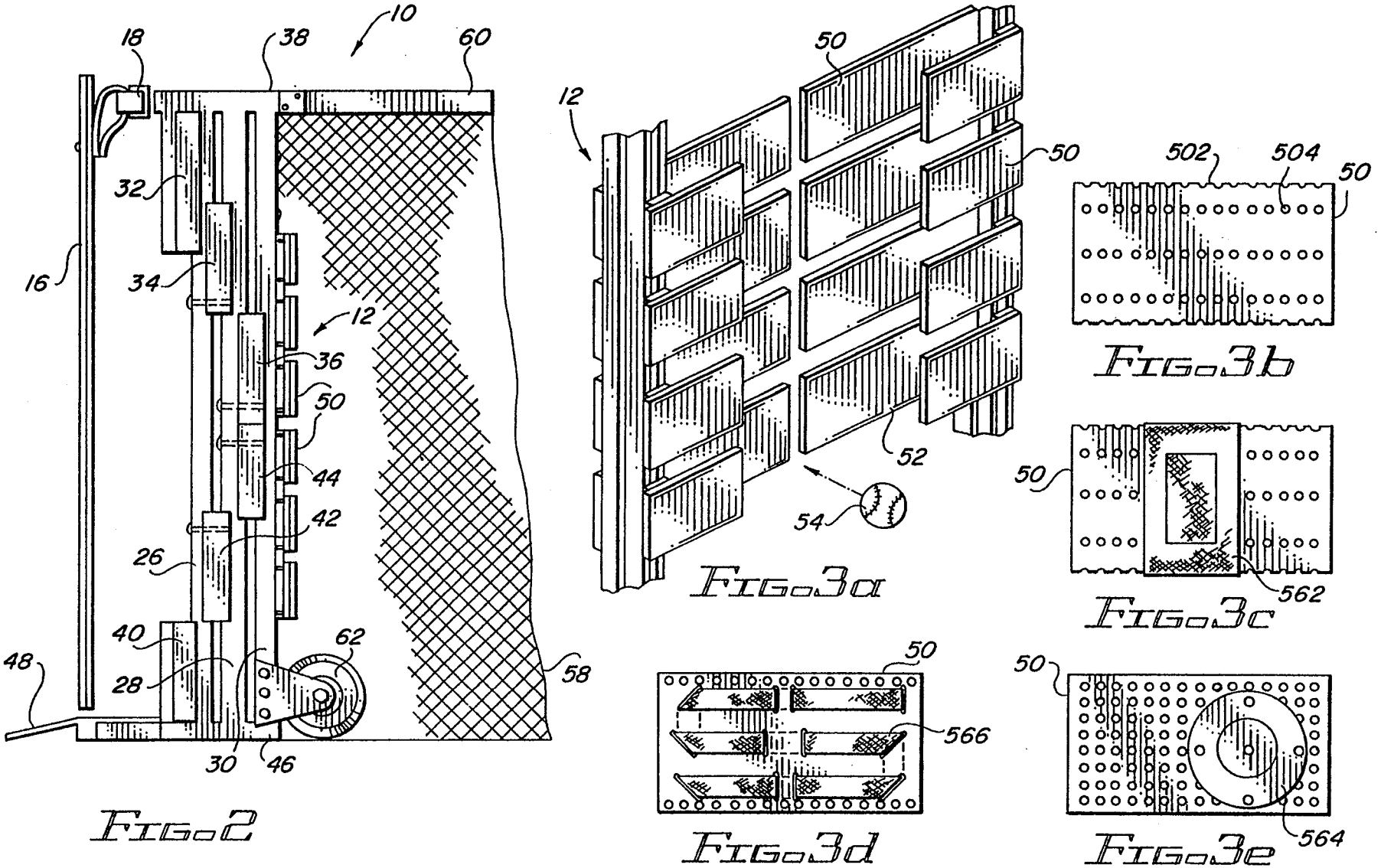
FIG. 2 is a side view of the preferred embodiment of the sports target.

The preferred embodiment of the invention, a sports target 10, is shown in the partially exploded perspective illustration for FIG. 1. The target 10 comprises a frame 12 from which a first shutter 14 and a second shutter 16 not shown in FIG. 1) are suspended. The first 14 and second 16 shutters are held away from the frame 12 by slide racks 18. A shock absorbent fascia member 20 is affixed to the shutters forward of the racks 18 so as to provide added energy absorbent capability at the structural connection between the shutters 14 and 16 and the frame 12. As illustrated in the side view of the preferred embodiment in FIG. 2, the shutters 14 and 16 are suspended away from the frame 12. By use of a rack guide 22, the slide rack 18 and thus the shutters 14 and 16 are movably affixed at selected positions. Note that an alternate slide rack 18 is shown in FIG. 2. Alternate slide rack 18 configurations have been developed and will be discussed in more detail later in this section.

With further reference to FIGS. 2 and 3, the frame 12 comprises slide rails 24. In the preferred embodiment, three slide rails 24 are used for each of the vertical members of the frame 12. It is preferred that as least two slide rails 24 run the complete height of the frame. The embodiment illustrated in FIGS. 1 and 2 contains a forward 26, middle 28 and aft slide rail 30. A first upper shutter 32 is affixed to the frame 12 in front of the forward slide rail 26. A second upper shutter 34 is movably affixed between the forward 26 and middle 28 slide rails. In the preferred embodiment, a third upper shutter 36 is movably affixed between the middle 28 and aft 30 slide rails. As illustrated in FIG. 1, the upper first shutter is spaced from an upper support member 38 of the frame 12 and the upper shutters 32, 34, and 36 are placed in spaced relation to each other and can more effectively absorb the energy of an incoming projectile. In a similar manner, first 40, second 42, and third 44 lower shutters are placed in special relation to each other and to a base support member 46 as illustrated in FIGS. 1 and 2. A plate assembly 48 is affixed to the base support member 46 for stability of the target 10.

As further illustrated in FIG. 1, target elements 50 are rotatably placed within an opening 52 defined and dimensionally adjusted by the adjustment of the shutters 14, 16, 32–36, and 40–44 so that a projectile 54 may pass as illustrated in FIG. 3*a* showing a partial view of the opening 52, frame 12 and target elements 50. Various target element configurations are rotatably placed within the opening 52 based on a specific training drill. Sample target elements 50 are illustrated in FIGS. 3*b*–3*e*. Element markers 56 are affixed to the elements 50 as a means for recording a hit on a certain target. The target element 50 of FIG. 3*b* illustrates an element having a serrated border 502 and holes 504 in order to better hold elastic markers 562 as illustrated in FIG. 3*c* or pegboard styled markers 564 as illustrated in FIG. 3*e*. VELCRO adhesive strips and attached VELCRO ribbon markers 566 are illustrated in FIG. 3*d*. The technique in rotatably affixing the elements 50 to the frame 12 requires a detailed discussion to better appreciate the invention. Such a discussion is provided later in this section.

As additional features of the preferred embodiment, a net 58 is suspended from a net support 60 attached to the frame 12 at the upper support member 38 as illustrated in FIGS. 1 and 2. The net 58 performs the function of collecting those projectiles 54 that pass through the opening 52. Wheels 62 are affixed to the base support member 46 aft of the target frame 12 for ease in relocating the target to locations appropriate for a selected training drill.

Alternate Embodiments

Figure 4A:
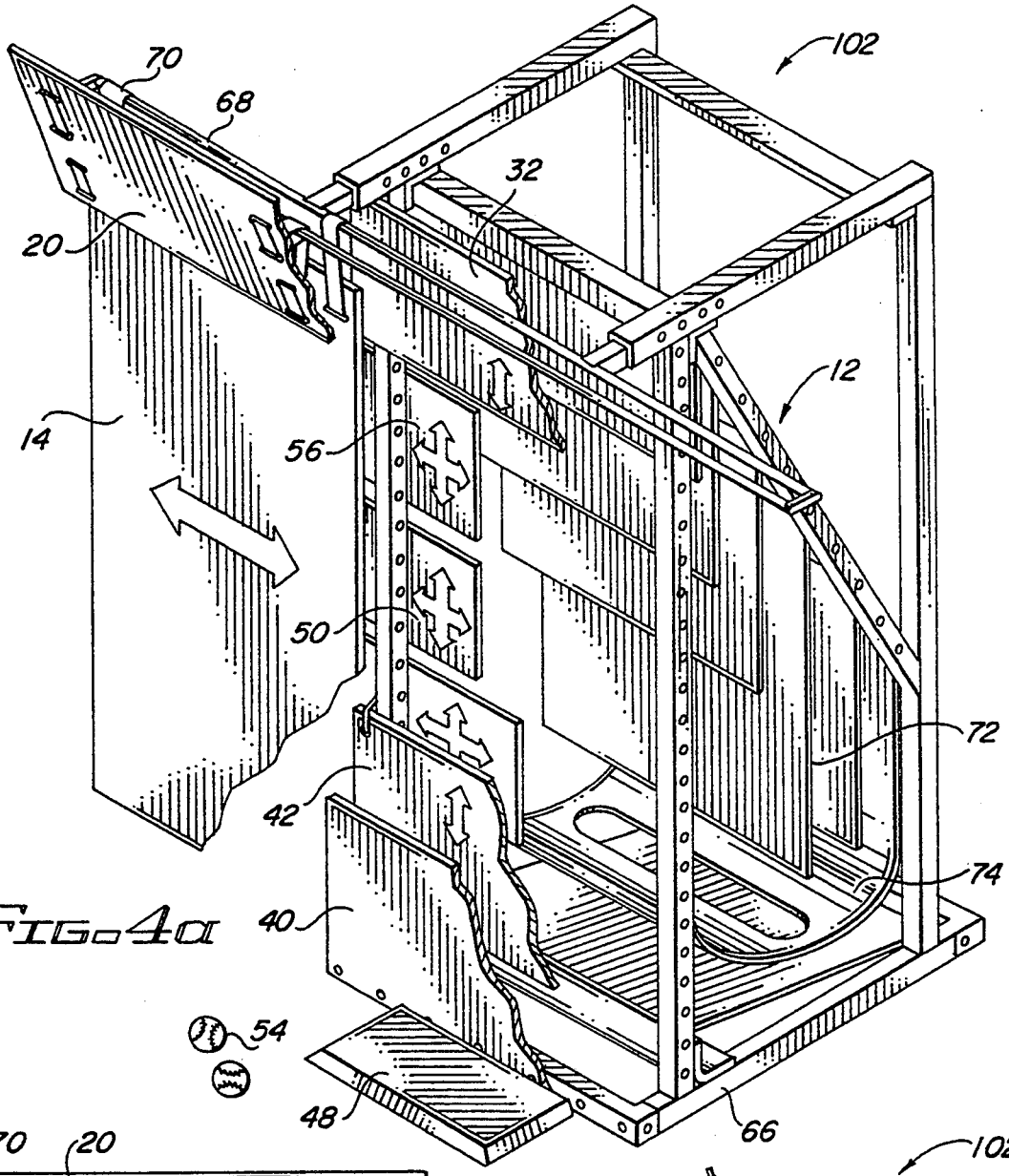
FIG. 4*a* is a partial cut-away perspective view of an alternate embodiment of the sports target illustrating alternate shutter and projectile collection configurations.
Figure 4B:
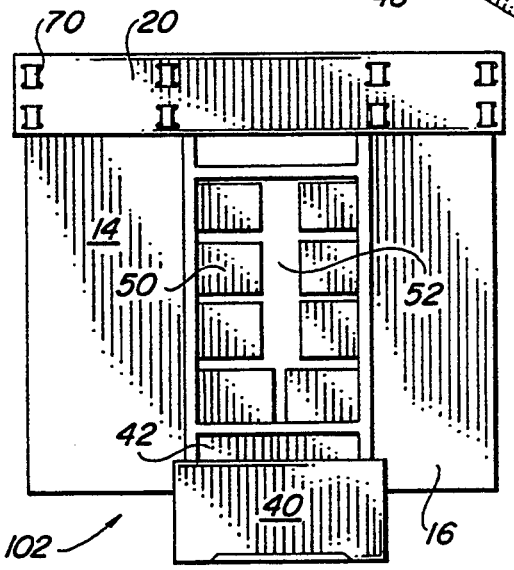
FIG. 4*b* and 4*c* are front and side views of the alternate sports target described in FIG. 4*a;*
Figure 4C:
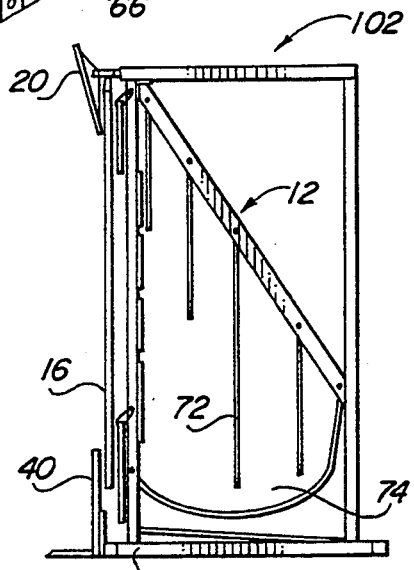
Figure 5:
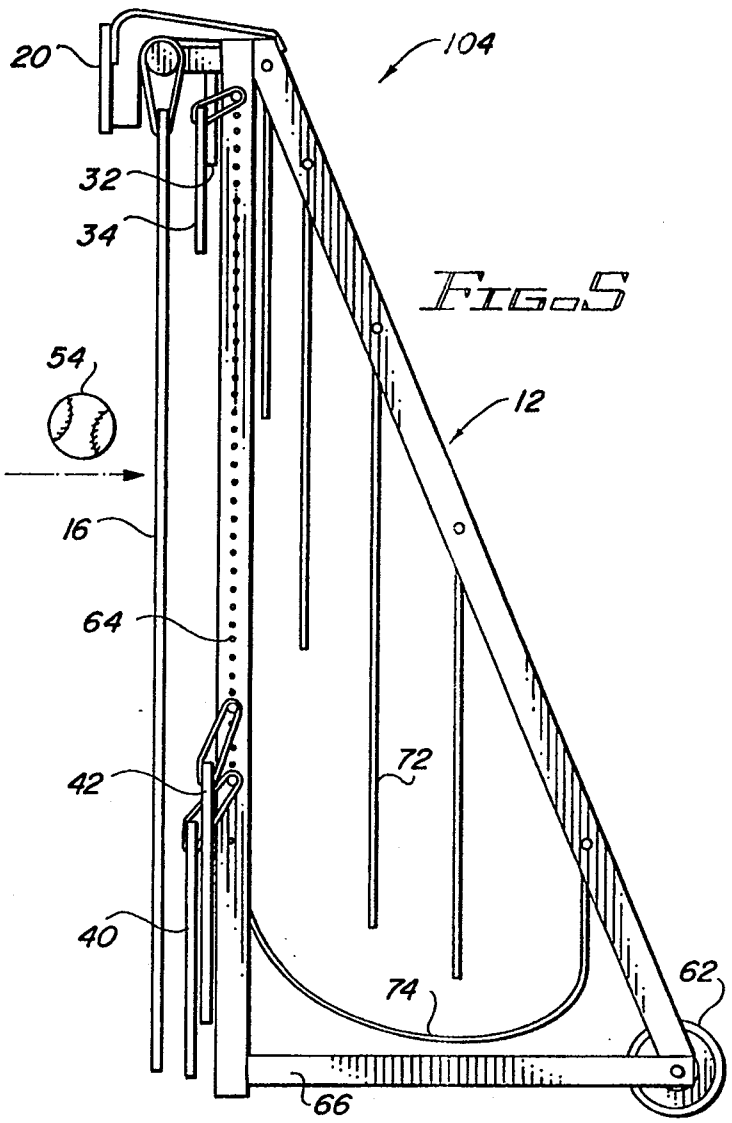
FIG. 5 is a side view of a second alternate embodiment of the sports target illustrating alternate shutter and fascia member configurations.
Figure 4D:
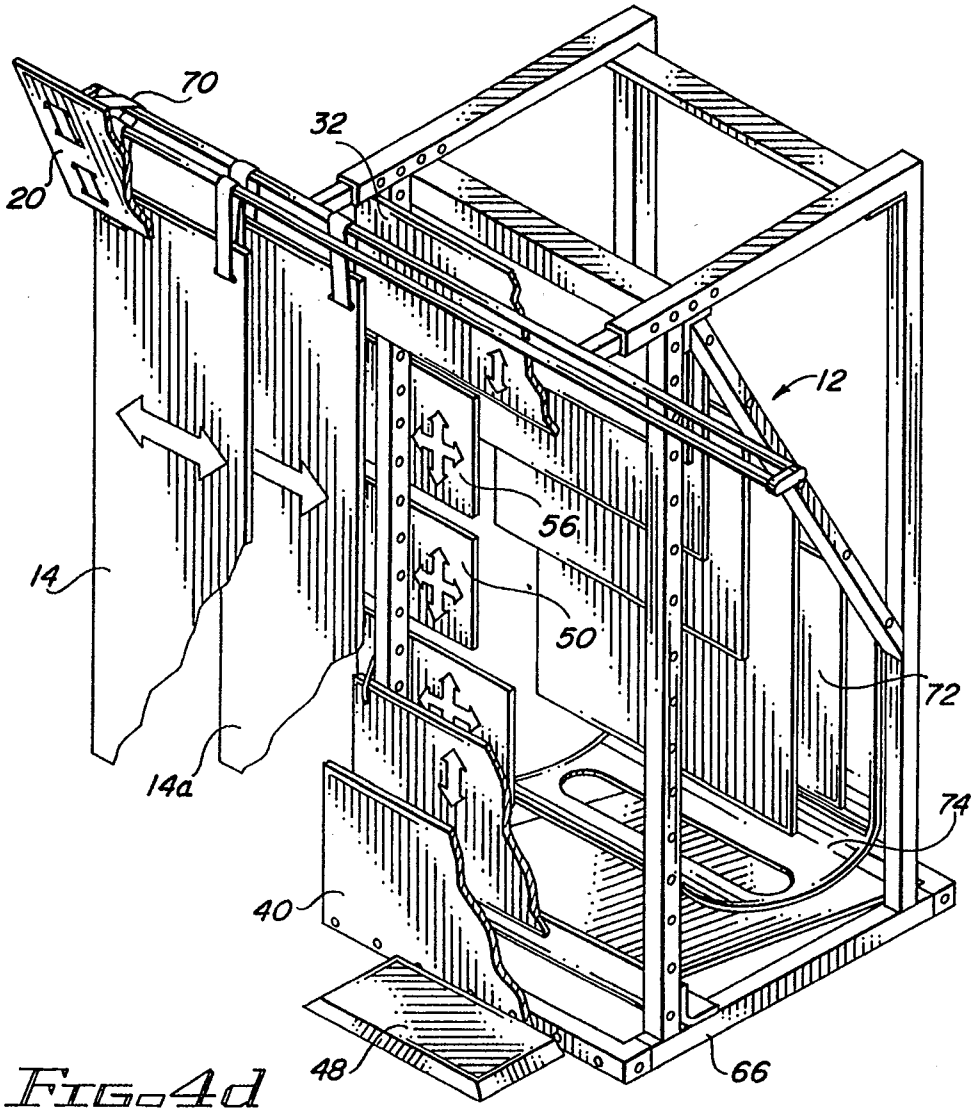
FIG. 4*d* illustrates the use of multiple first and second shutters shown by way of example with the alternate sports target embodiment.

Alternate embodiments of the frame 12 styled targets 102 and 104 are illustrated in FIGS. 4*a* through 4*d* and FIG. 5 illustrating a frame 12 having a single slide rail 64 from which a first upper shutter 32 and a second lower shutter 42 are suspended. Through a varied configuration of the base support member 66 as illustrated in FIG. 4*a*, the first lower shutter 40 is affixed and held away in spaced relation from the second lower shutter 42. As further illustrated in FIG. 4*a*, the first shutter 14 and the second shutter 16 (not shown) are suspended from an alternate rack guide 68 using straps 70 and are held away from the frame 12. The shock absorbent fascia member 20 is also suspended from the guide 68 using the straps 70. Rather than the net 58 used in the preferred embodiment of FIGS. 1 and 2, baffle members 72 are suspended from the frame 12 aft of the opening 52. The baffle members 72 absorb the energy of the projectile 54 that passes through the opening 52 and causes the projectile 54 to drop down to the bottom of the target 102 where a collection member 74 directs the projectile 54 to the bottom of the target. Reference to FIG. 4*b*, a front view of the target 102, illustrated the placement of the first lower shutter in front of the first 14 and second 16 shutters as an alternative to the configuration shown in the preferred embodiments of FIGS. 1 and 2. FIG. 4*c* is a further illustration of the target 102 through the use of a side view. FIG. 4*d* illustrates the use of multiple first 14*a* and second 16*a* (not shown) shutters with the target 102. Multiple shutters can be configured with the preferred embodiment as well. In yet another embodiment, the target 104 illustrated in FIG. 5 shows an alternate configuration for suspending the shutters 14 and 16 forward of the upper and lower shutters 32, 40, and 42. In addition, the shock absorbent member 20 is shown in an alternate configuration which will be discussed in detail later in this section. As in the preferred embodiment, the target 104 illustrated in FIG. 5 has wheels 62 rotatably attached to the bottom of the frame 12.

Figure 6A:
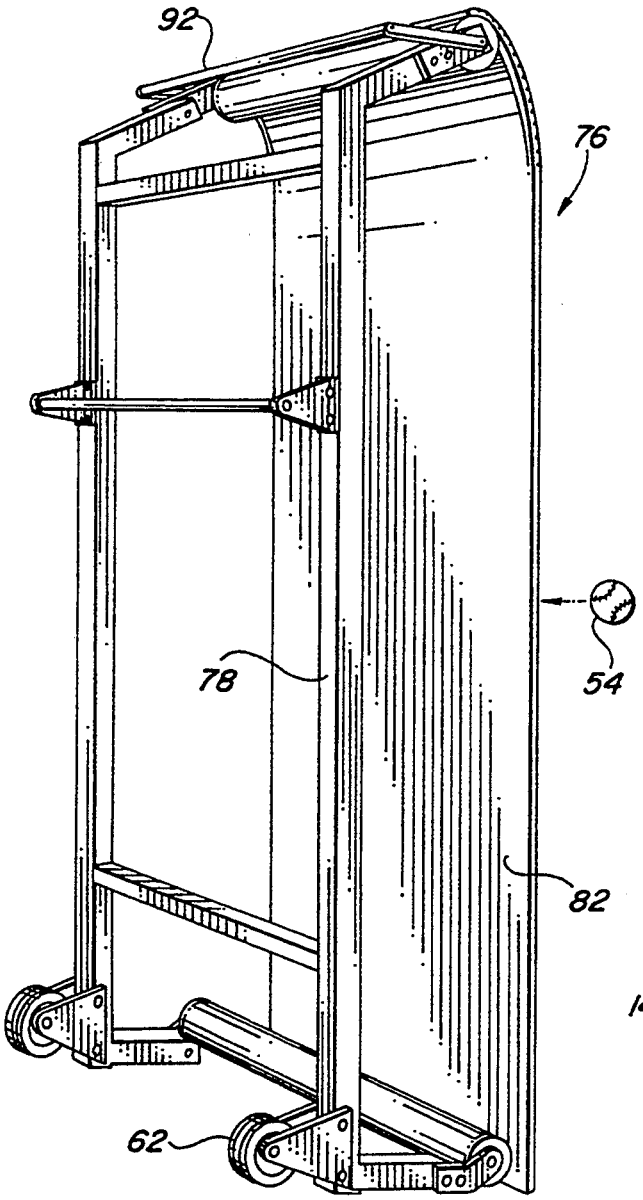
FIG. 6*a* is a perspective rear view of a first or second shutter affixed to a second frame.
Figure 6B:
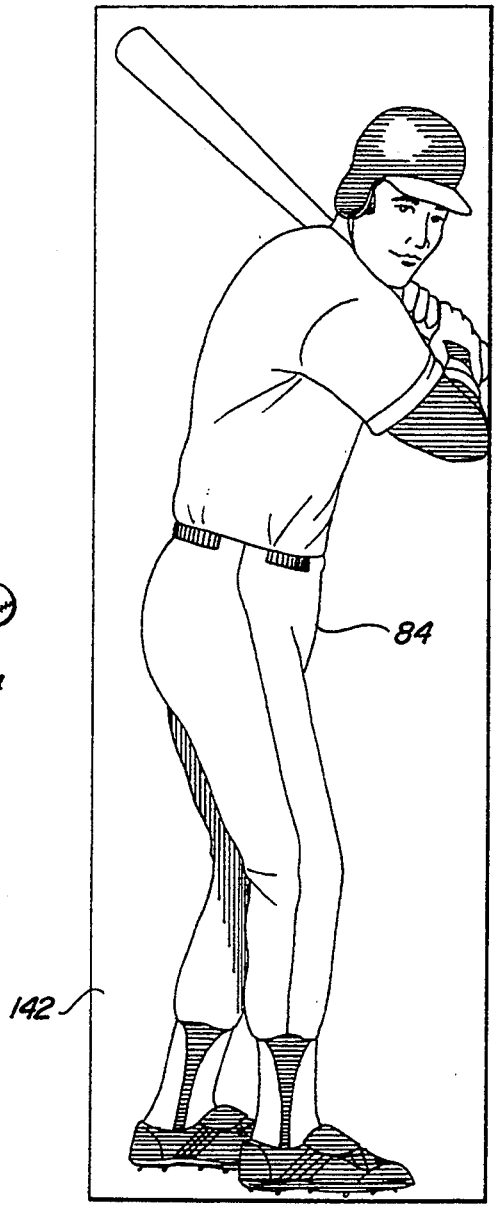
FIG. 6*b* illustrates the placement of an alternate target market such as an image of a left handed player in the batting position affixed to the first shutter.
Figure 8A:
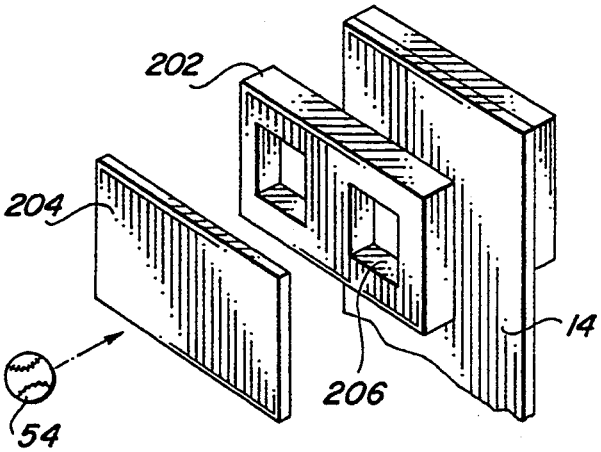
FIG. 8*a* and 8*b* illustrate alternate embodiments for an energy absorbent shutter structure.
Figure 8B:
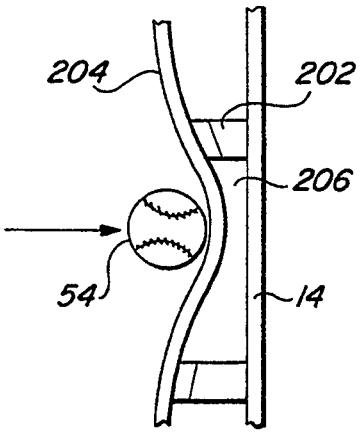
Figure 7A:
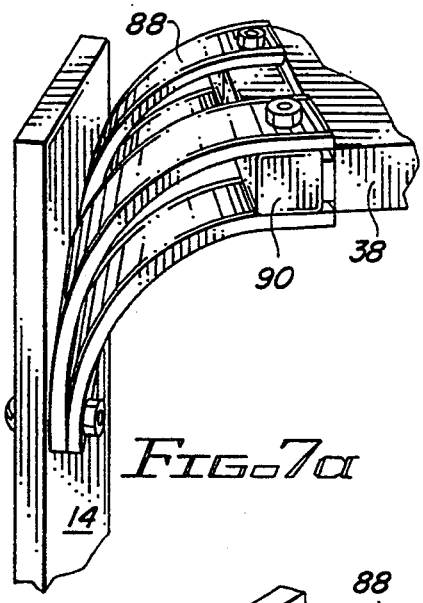
FIG. 7*a*–7*d* are partial perspective views illustrating alternate means for energy absorption of the projectile using various first and second shutter suspension means.
Figure 7B:
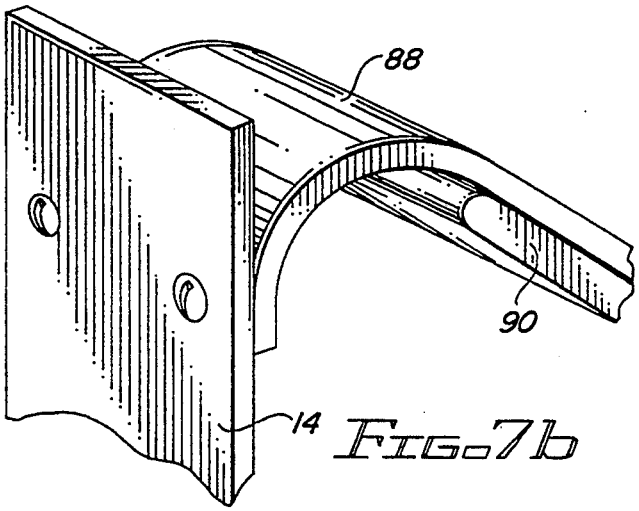
Figure 7C:
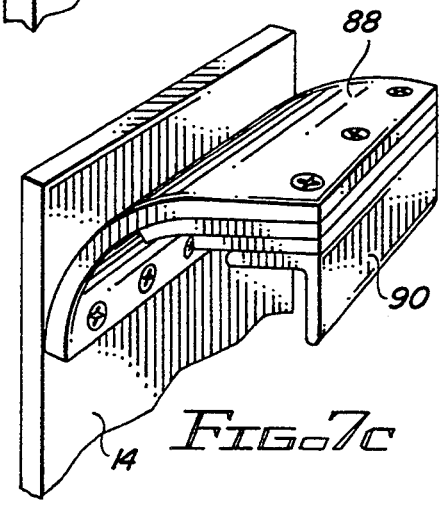
Figure 7D:
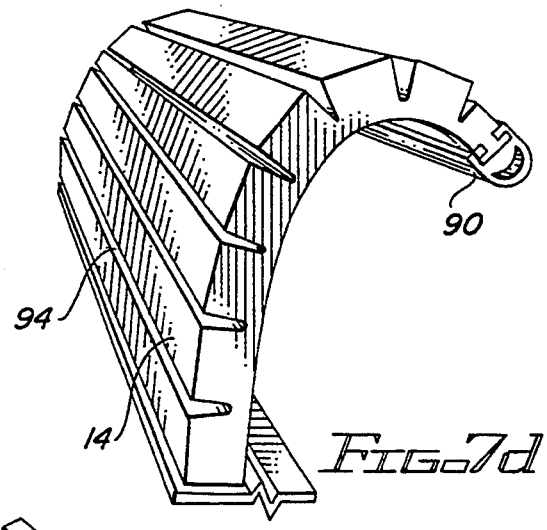
Figure 8C:
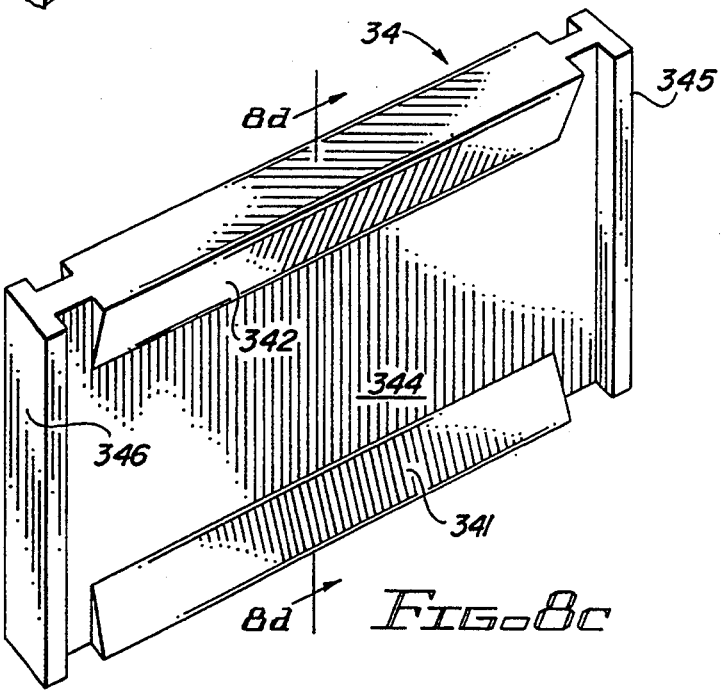
FIGS. 8*c* and 8*d* illustrate edges formed for accurately deflecting the projectile away from the aperture.
Figure 8D:
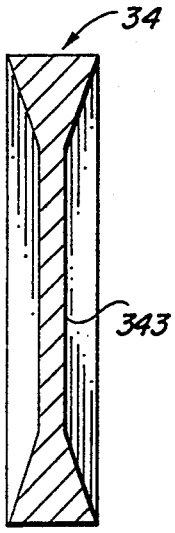
Figure 9A:
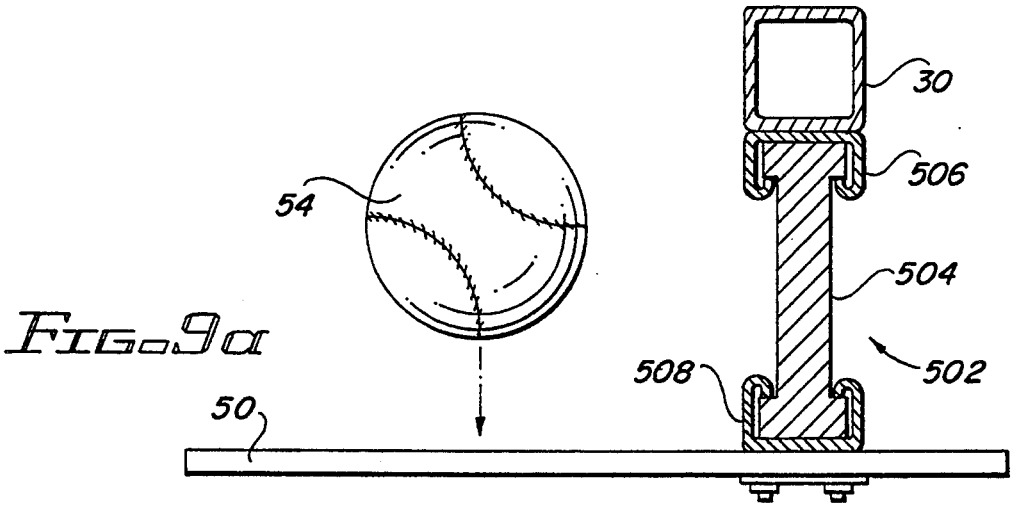
FIG. 9*a*–9*e* illustrates the alternate embodiment for affixing the target elements to the frame.
Figure 9B:
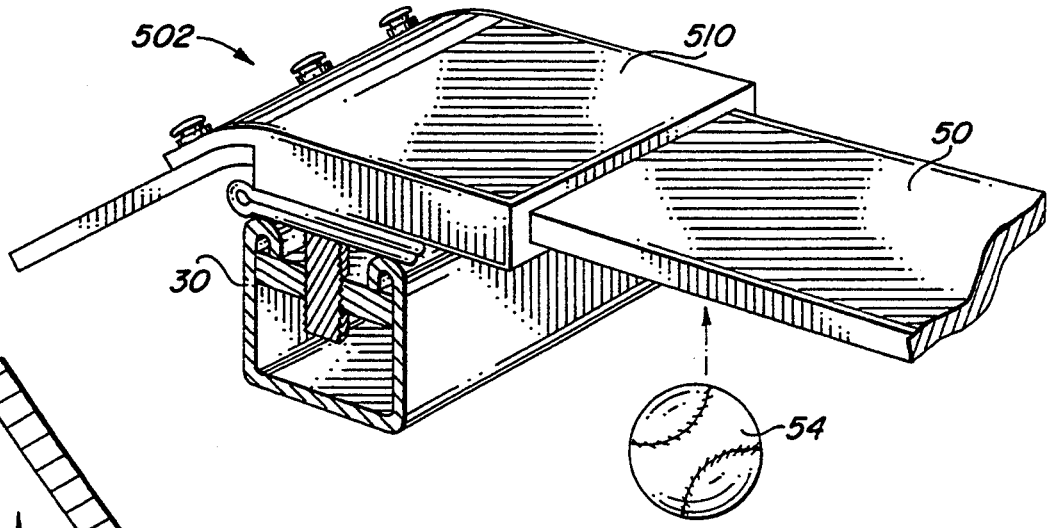
Figure 9E:
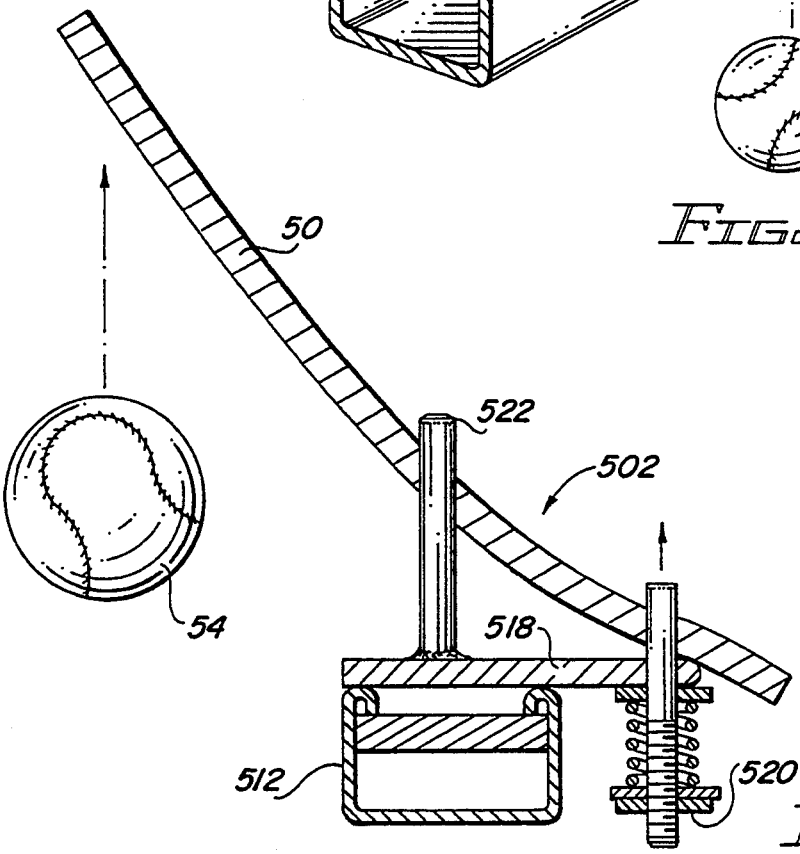
Figure 9C:
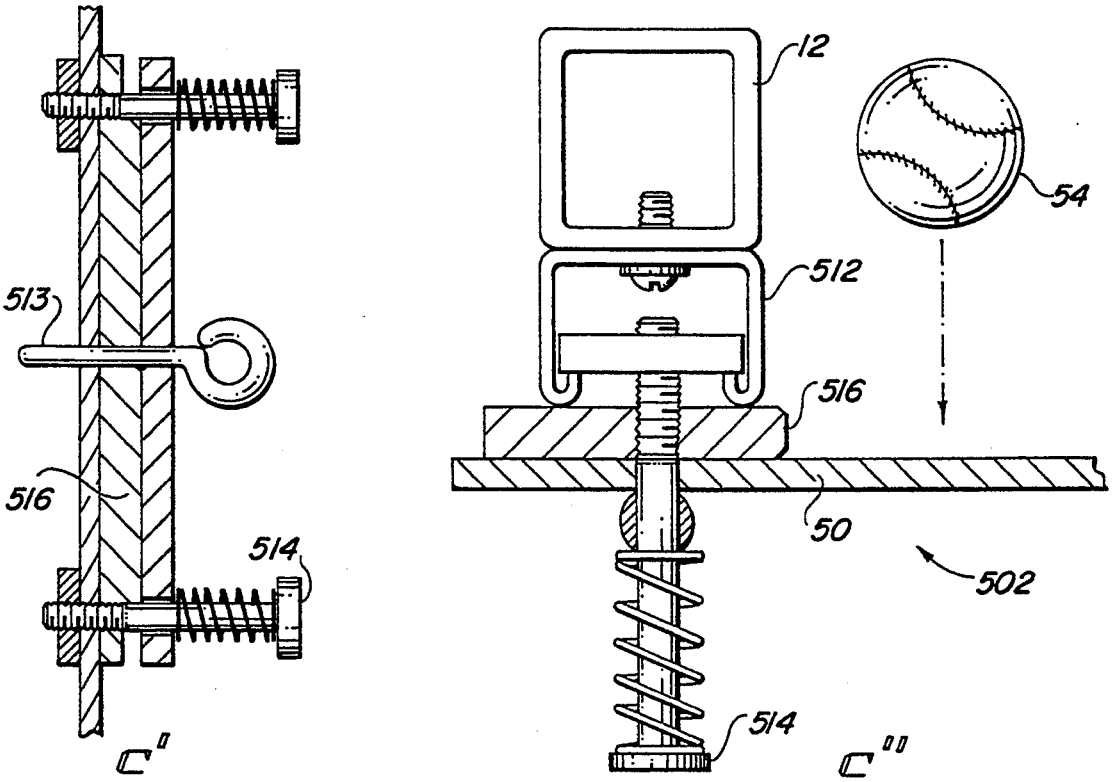
Figure 9D:
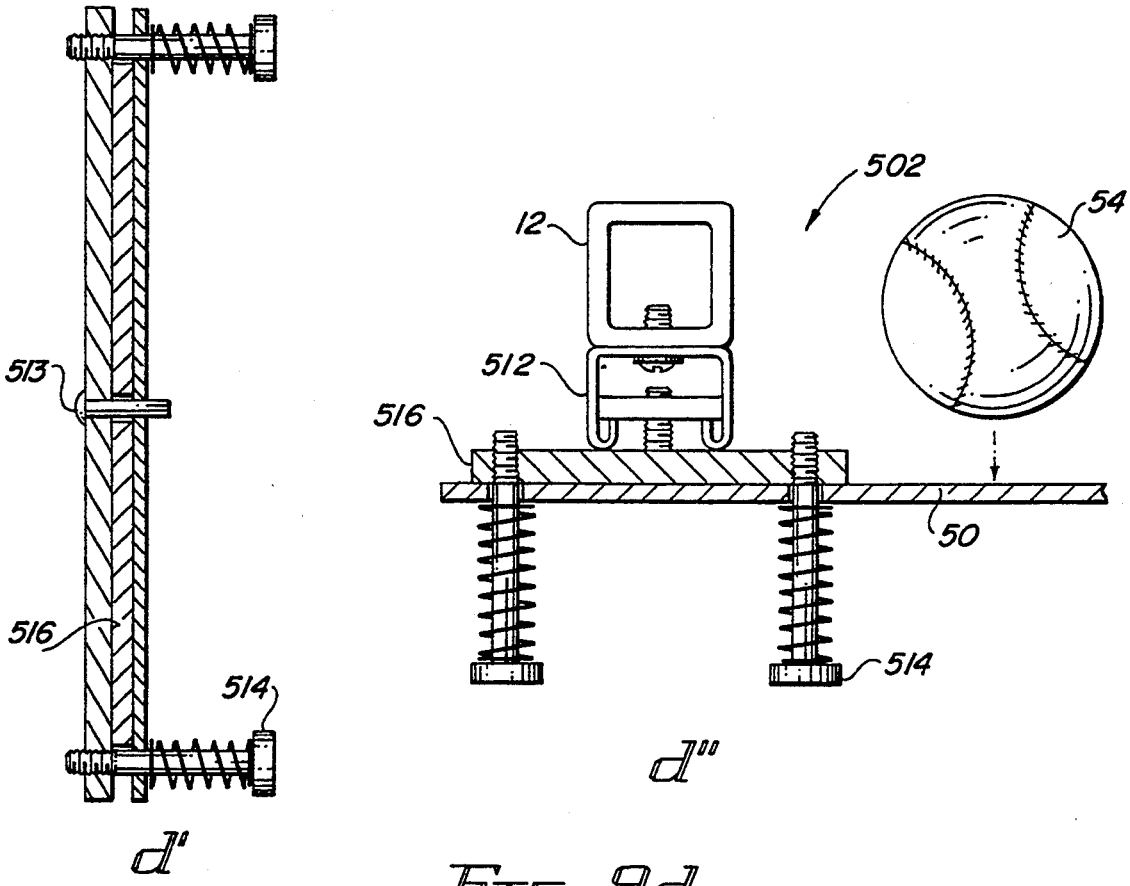

The first shutter 14 can be configured for attachment to the slide rack be as illustrated earlier in FIG. 1 or as in the alternate target embodiments discussed. In yet another embodiment, the first shutter 14 is suspended from a second frame 76 as illustrated in the perspective rear view of FIG. 6*a* where a screen 76 having a screen frame 78 is used with an independent shutter 80. A screen shutter member 82 will have an image 84 affixed to the front surface and used in conjunction with the target be for placement in front of the target 10. With an image as illustrated in FIG. 6*b*, a baseball pitcher can create simulated strike zone conditions by setting the target elements 50 as desired for the left handed batter of FIG. 6*b* or a similar right handed batter image placed on the screen member 82. Further reference to the screen 76 of FIG. 6*a* illustrates the use of wheels 62 for mobility as in the preferred embodiment of the invention. The wheels 62 are affixed to a base support member 86 of the screen frame 78. As in the preferred embodiment of the target 10 and in alternate embodiments, the screen member 76 is suspended and held away from the frame 78 in order to effectively absorb the energy of a projectile 54 hitting the screen member 82. Suspension of the screen member 82 from the frame 78 is accomplished in the same manner as discussed earlier and as further detailed below.

Energy Absorbent Structure

Low rebound surfaces are needed for the shutters in the preferred as well as alternate embodiments. All shutters are fabricated using a composite material called macerated rubber, a tough, flexible, energy damping form of rubber containing randomly distributed fibers. Correctly mounted or suspended, this material provides a "dead" or low rebound surface which sustains little or no damage when struck repeatedly by sports projectiles 54 such as baseballs and at high projectile speeds such as speeds in excess of 100 mph as is the case in professional baseball. Shutter thicknesses will range from ¼" to 1-½" in the preferred embodiment depending on whether tapered shutter edges or reinforced edges 142 are used as illustrated in FIG. 1 of the preferred embodiment. By reinforcing the edges, a thinner and therefore lighter shutter can be used without the shutter edge distorting after much bombardment resulting in unwanted random projectile deflection. Consistent deflection performance at shutter edges is maintained with the reinforcement illustrated above in FIG. 1 or by thickening shutter peripheral edges, beveling edge surfaces inward, adding stiffeners or any combination thereof. Reducing rebounding is further achieved by suspending shutters using the techniques as illustrated in FIGS. *7a* through *7d* wherein various configurations of the macerated rubber are used in a hinged fashion to suspend the shutters and hold them away from the frame 12. As illustrated in FIGS. *7a, 7b* and *7c,* single and multiple layers of rubber sheets 88 have one end of the sheet affixed to the shutter 14 by way of example, and another end affixed to a sheet support 90 that attaches to a frame member such as the slide rack 18 in the preferred embodiment or the upper support member 38 in alternate embodiments. With reference to FIG. *7d,* it can be seen that the shutter itself is rolled over a corner of a frame member such as the upper support member 92 illustrated in the screen 76 of FIG. *6a.* Slots 94 are created in the upper end of the shutter member 82 for enhanced flexibility.

As one skilled in the art would expect, the structural connecting points in the target 10 create the more solid contact points for the projectile 54. In particular, the front most exposed surface of the target, the shock absorbent fascia member 20 is such a point as can be seen with reference again to FIG. 1. To further absorb the energy of the projectile 54, an inner foam rubber sheet 202 is affixed to the shutter 14 and a first rubber sheet 204 is affixed onto the inner foam rubber sheet 202. The inner rubber sheet contains hollowed out portions 206. Such a combination using the macerated rubber for the shutters and first rubber sheet 204 has proven effective in tests using baseballs hurled at the target 10 at speeds in excess of 100 mph. FIGS. *8a* and *8b* illustrate such an arrangement for an effective energy absorbent fascia member 20 in the preferred embodiment. It will be obvious to one skilled in the art that various combinations of rubber sheets and suspension methods can be derived from the above disclosure.

When moving objects impact resilient, flexible, uniformly thick shutter surfaces at or near the center of the shutter, surface resistance is uniform and normal incidence/reflection angles are maintained. However, near shutter edges resistance decreases and the shutter surface deforms in an increasingly non-uniform fashion as impacts approach the edge, until finally the incoming object is able to pass through the shutter plane by deflecting the shutter edge out of its path. By way of example and as illustrated in FIGS. *9a* and *9b,* a shutter, in this example the second upper shutter 34 shown in FIG. 1 is dimensioned with edges 341 and 342 having an increased thickness at the leading edge 341 and tapering to the shutter thickness 343 inward toward the center 344. It is possible to decrease inaccurate shutter performance by selectively increasing shutter thickness near such leading edges around the aperture 52 by changing the angle presented by the surface near edges. These beveled edges are formed at least on all edges where the aperture 52 is defined. In the case of the shutter 34, the left and right sides 345 and 346 are slidably affixed between opposing forward and middle slide rails 26 and 28.

Target Element Embodiments

As has been discussed, absorbing projectile energy is needed to create safe conditions and maintain a sound target structure. In addition, the high speed and resulting high energy of the projectile 54 such as a baseball or hockey puck plays havoc with the target elements 50. Targets elements 50 must be able to take a hit by the projectile, rotate so as to allow the projectile to pass through the opening 52, and return to their original position within the opening 52 for repeated bombardment. After much testing and development, it was concluded that the preferred material for the target is the macerated rubber sheeting. FIGS. *9a* through *9e* illustrate a variety of effective target element hinge assembly 502 designs. As of this writing, the simpler design of FIG. *9a* is preferred. In this configuration, a flexible rubber hinge flap 504, is affixed at one end to a first channel iron bar 506 and at a second end to a second channel iron bar 508. The first bar 506 is affixed to the frame 12 and the second bar is affixed to the target element 50. In the embodiment of FIG. *9b,* a suspension clamp 510 affixes the target element 50 to the frame 12 and the target element 12 is made of the macerated rubber which flexes when hit by the projectile. It has been determined that making the target elements from macerated rubber sheets is preferred. In alternative embodiments for the target hinge assembly 502, the target element 50 is affixed at one end to a channel 512 by spring loaded pins 514 rotatably affixing the element 50 to the channel 512 which in turn is affixed to the frame 12. A guide pin 513 holds the element 50 in place during rotation. A rubber sheet 516 is placed between the element 50 and the channel 512 for added flexibility and rotate ability. FIG. *9c* illustrates this embodiment for two pins 514 in side (*9c'*) and top (*9c''*) views of the embodiment. FIG. *9d* is a similar design using a four pin 514 configuration which extends the reliability of this spring loaded pin embodiment. In yet another embodiment of the target element hinge assembly 502, seen in FIG. *9e,* the target element 50 is rotatably affixed to a steel plate 518 using a spring loaded U-bolt 520. The element passes under a guide member 522 affixed to the plate 518. The plate is affixed to the frame 12. In this way, the element 50 is allowed to rotate allowing the projectile to pass through the opening and return to its original position after being hit by the projectile 54. Again referencing FIG. *3a,* it can be seen that the above element embodiments can be dimensioned to extend completely or partially into the opening 52. In addition, by varying the length of selected hinges 504 for the embodiment of FIG. *9a* or by adding spacers between the clamp 510 of the embodiment on FIG. *9b,* the target elements 50 can be spaced forward or aft relative to the path of the trajectory for varied target element combinations.

Targets without Frame Structure

Figure 10A:
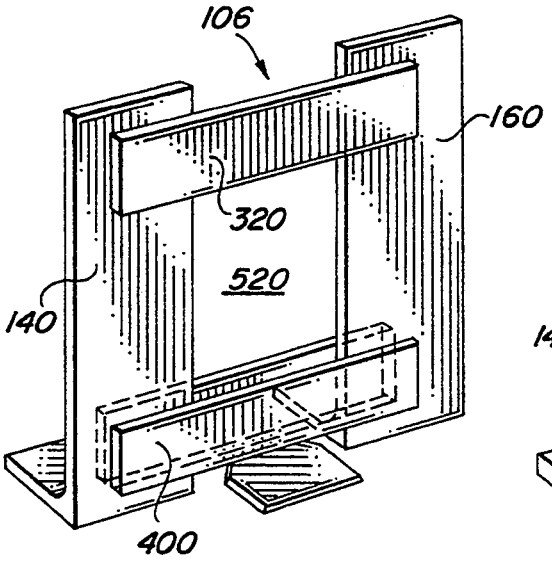
FIG. 10*a*–10*c* illustrate alternate embodiments targets using shutter structures to define the opening.
Figure 10B:
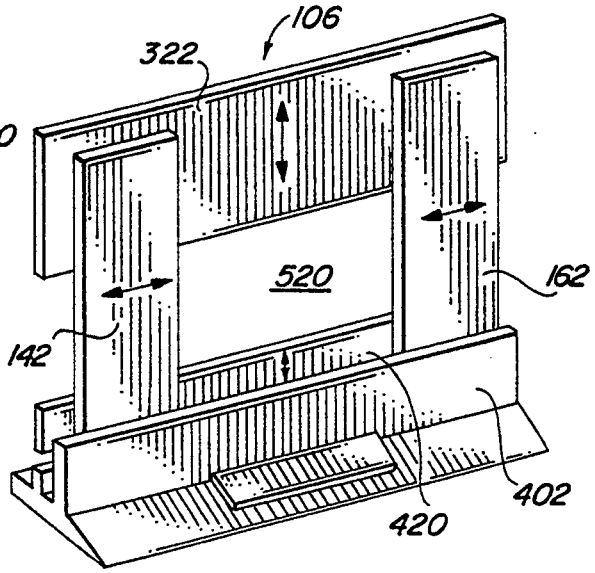
Figure 10C:
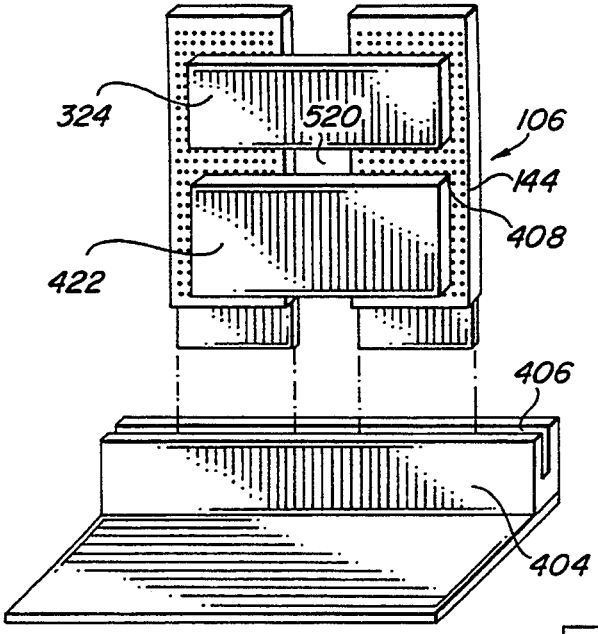

The macerated rubber material has proven to effectively absorb the energy of the oncoming projectile and providing the safety sought as well as protecting the target frame structure. By using thicker rubber sheets and forming them to fit together with each other, an effective alternate embodiment to the target 106 invention is made without the need for a frame 12. With reference to FIGS. 10*a* through 10*c*, it is appreciated that basic target embodiments are formed by providing a first 140 and a second 160 free standing shutter and affixing an upper shutter 320 and a lower shutter 400 so as to form an opening 520. FIG. 10*a* illustrates such an embodiment using a perspective front view. With reference to FIGS. 10*b* and 10*c*, alternate embodiments of the target 106 without a frame 12 are shown using a first lower shutter formed into a base support 402 within which the first 142 and second 162 shutters are affixed. The upper shutter 322 is affixed across the tops of the spaced shutters 142 and 162 to form the opening 520 through which the projectile is thrown. For additional portability in this embodiment, shutters 144 and 164 are formed to fit within a groove 406 within the lower base shutter 404. The upper 324 and second lower 422 shutter are removably affixed to the shutters 144 and 164 using hooks 408 and affixing the hooks 408 to perforations 410 placed within the shutters. The shutters are adjusted to set the preferred opening.

Close Range Batting Configuration

Figure 11:
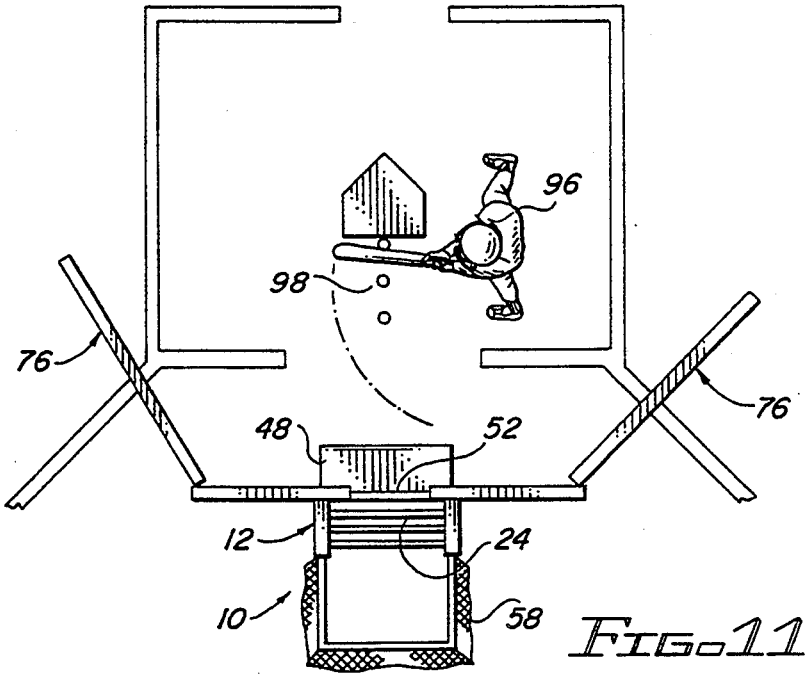
FIG. 11 is a top view of the sports target and player illustrating the use of the preferred embodiment of the sports target with additional shutters arranged for close range bating drills.

The use of low rebound surfaces as herein described permits the target 10 and its alternate embodiments to be used in a close range batting configuration as illustrated in FIG. 11 showing an aerial view of a right handed batter 96 hitting from a stationary "T" 98 or "soft toss" into the target 10 or the screens 76 which are placed beside the target 10. The target shutters 14 and 16 and the screens 76 are placed in the path of the batted ball. Various markers are placed on the shutters and screens for achieving specific hitting drills and developing specific batting skills. In this manner, visual games simulations in combination with aperture targeting for greater realism and performance assessment. Visual images or markers are placed at various locations on the shutter or target elements for specific drills while catering to the skill levels to be achieved by the batter 96.

Variable Range Pitching Drills

Figure 12A:
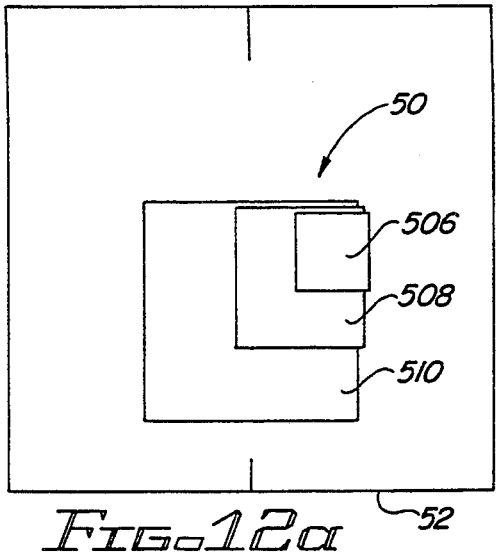
FIGS. 12*a* and 12*b* are partial front views of the target opening illustrating alternate configurations of target elements and markers for use in variable range pitching drills for a ¾ and side arm pitcher respectively by way of example.
Figure 12B:
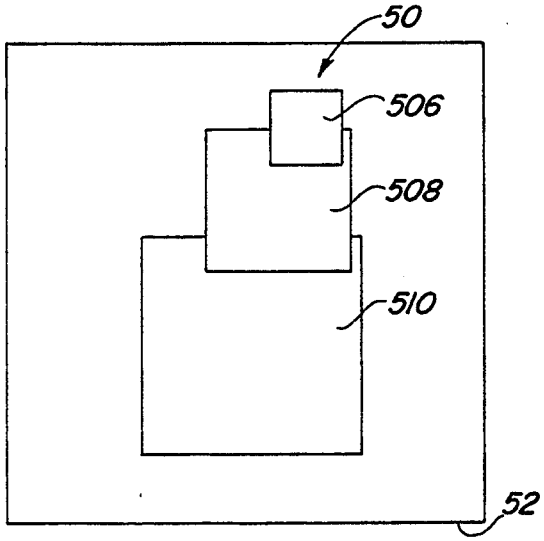
Figure 12C:
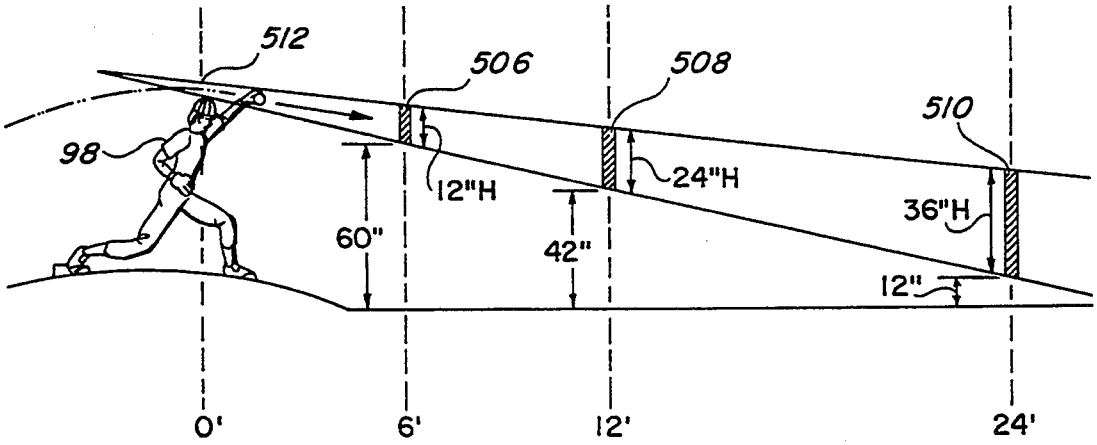
FIGS. 12*c* and 12*d* illustrate the relationship between target elements or marker sizes with respect to the distance between the pitcher and the target.

In using the target 10 for variable range pitching drills, target elements 50 are sized to accommodate the distance from the target 10 and located within the opening to accommodate the parallax effect of a pitcher 98 being closer to the target than is the case for actual game conditions. Targets are proportionally sized by way of example for target distances of 6 feet, 12 feet and 24 feet and are illustrated in FIG. 12*a* as 506, 508, and 510 respectively. The pitcher would throw to the target that corresponds to his distance from the target as illustrated in FIG. 12*c*. The position of the target elements are adjusted to compensate for the various pitching styles, for example, a ¾ overhand pitcher as illustrated in FIG. 12*b* and a side arm pitcher as illustrated in FIG. 12*a*. As further illustrated in the elevation view of FIG. 12*c* and aerial view of FIG. 12*d*, the positioning of the targets is based on the distance from the target and the horizontal and vertical position of the ball release point of the pitcher 98.

Figure 12D:
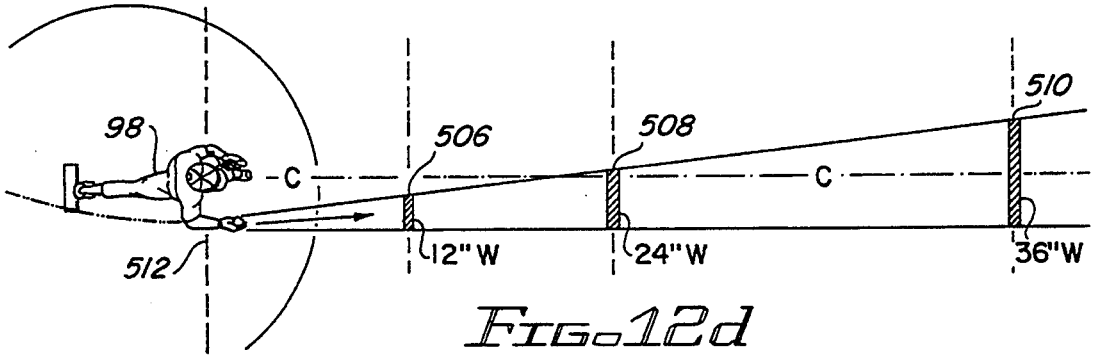

Target elements 506, 508 or 510 must be proportional to a full scale target at a full scale distance and be aligned within the limits formed by the original release point 512 of the pitcher 98 and the borders 514 of the original full scale target as illustrated in FIGS. 12*c* and 12*d*. Since the object of a reduced range (e.g. 6, 12, or 24 feet as illustrated) is to simulate as closely as possible the motions of full range pitching, preserving the release point is critical to an effective drill. Orienting the target elements as described accomplishes this realism. It is worth noting that the examples given are with right handed pitchers with both target elements displaced toward the right as seen in FIGS. 12*a* and 12*b*. In a mirror image fashion, a left handed simulation can be accommodated. However, this displacement pattern does not necessarily apply to the full overhand pitcher. Here the plane of hand motion is often the same as the plane of forward body motion. Target elements accommodating the full overhand pitcher will follow the trend of going from a side to ¾ pitcher but target element simulations will show progressive upward displacement but little lateral displacement.

With the preferred embodiment of the target fully described and alternate target and target component embodiments shown, it is anticipated that one skilled in the art of sports training can devise other embodiments and combinations of elements disclosed.

What is claimed is:

1. A sports target for a projectile such as a baseball or a hockey puck, the target comprising:

a frame defining an opening;

adjustable shutter means fitted with the frame for permitting adjustments to a dimension of the opening, the adjustable shutter means mounted in spaced relation with the frame in a direction toward a player wherein the shutter means is positioned between a projectile tossed at the target and the frame for absorbing impact of the projectile and reducing rebounding of the projectile toward the player, the adjustable shutter means permitting an adjustment to a dimension of the opening, the adjustable shutter means further including means for protecting the frame from damage through impact with the projectile; and a plurality of resilient elements supported by the frame and extending into the opening.

2. The target as recited in claim 1, further comprising means for adjusting the extension of the resilient elements into the opening.

3. The target as recited in claim 2, wherein each element comprises a flap rotatably mounted on the frame.

4. A sports target for receiving a projectile thrown or hit by a player, the target comprising:

a frame having an opening; and adjustable shutter means mounted in spaced relation with the frame in a direction toward a player wherein the shutter means is positioned between a projectile tossed at the target and the frame for absorbing impact of the projectile and reducing rebounding of the projectile toward the player, the adjustable shutter means permitting an adjustment to a dimension of the opening, the adjustable shutter means further including energy absorbing means for protecting the frame from damage through impact with the projectile.

5. The target as recited in claim 4, wherein the energy absorbing means comprises a first rubber layer having spaced openings, the first layer affixed between a second and third rubber layer.

6. A sports target useful in safely developing accuracy and technique in a player delivering a projectile such as a baseball or hockey puck to a preferred location, the target comprising:

a frame;

a first shutter movably supported in spaced relation from the frame in a direction toward the player, the first shutter forming a shield across a first portion of the frame;

a second shutter movably supported in spaced relation from the frame in a direction toward the player, the second shutter forming a shield across a second portion of the frame;

a first upper shutter supported in spaced relation from the frame in a direction toward the player, the first upper shutter forming a shield across a third portion of the frame;

a second upper shutter supported by the frame, the second upper shutter in spaced relation to the first upper shutter;

a first lower shutter supported in spaced relation from the frame in a direction toward the player, the first lower shutter forming a shield across a forth portion of the frame; and a second lower shutter supported by the frame, the second lower shutter in spaced relation to the first lower shutter, wherein the shutters together totally shield the frame, the shutters together form an opening through which the projectile can pass.

7. The sports target as recited in claim 6, further comprising:

a multiplicity of first shutters movable supported in spaced relation to the frame in a direction toward the player, at least one first shutter forming a shield across a first portion of the frame;

a multiplicity of second shutters movable supported in spaced relation to the frame in the direction of the player, at least one second shutter forming a shield across a second portion of the frame;

a multiplicity of second upper shutters supported by the frame, each second upper shutter in spaced relation to each other and to the first upper shutter; and a multiplicity of second lower shutters supported by the frame, each second lower shutter in spaced relation to each other and to the first lower shutter, wherein the multiplicity of shutters together form the opening through which the projectile can pass.

8. The sports target as recited in claim 6, further comprising a plurality of target elements rotatably affixed to the frame, wherein each element extends from the frame at least partially into the opening formed by the shutters.

9. The sports target as recited in claim 8, wherein the target element further comprise means for removably affixing target markers to the element.

10. A sports target useful in safely developing accuracy and technique in a player delivering a projectile such as a baseball or hockey puck to a preferred location, the target comprising:

a frame having an upper support member and a base support member, the support members being separated by a first slide rail and a second slide rail, wherein the rails and members form a frame opening;

a first shutter movably supported in spaced relation to the upper support member in a direction toward the player, the first shutter forming a shield across the first slide rail;

a second shutter movably supported in spaced relation to the upper support member in a direction toward the player, the second shutter forming a shield across the second slide rail;

a first upper shutter supported in spaced relation to the upper support member in a direction toward the player, the first upper shutter forming a shield across the upper support member;

a second upper shutter movably attached to the slide rails, the second upper shutter in spaced relation to the first upper shutter, the second upper shutter communicating with the first upper shutter for expanding a surface area formed by the upper shutters;

a first lower shutter supported in spaced relation to the base support member in a direction toward the player, the first lower shutter forming a shield across the base support member; and a second lower shutter movably attached to the slide rails, the second lower shutter in spaced relation to the first lower shutter, the second lower shutter communicating with the first lower shutter for expanding a surface area formed by the lower shutters, wherein the upper and lower shutters and the first and second shutters together form an opening within the frame opening through which the projectile can pass.

11. The sports target as recited in claim 10, further comprising:

a multiplicity of first shutters movable supported in spaced relation to the upper support member in a direction toward the player, at least one first shutter forming a shield across the first slide rail;

a multiplicity of second shutters movable supported in spaced relation to the upper support member in a direction toward the player, at least one second shutter forming a shield across the second slide rail;

a multiplicity of second upper shutters movably attached to the slide rails, each second upper shutter in spaced relation to each other and to the first upper shutter; and a multiplicity of second lower shutters movably attached to the slide rails, each second lower shutter in spaced relation to each other and to the first lower shutter, wherein the multiplicity of shutters together form the opening within the frame opening through which the projectile can pass.

12. The sports target as recited in claim 10, further comprising a plurality of target elements rotatably affixed to the frame slide rails, wherein each element extends from the side rails at least partially into the opening formed by the shutters.

13. The sports target as recited in claim 12, wherein the target element further comprises means for removably affixing target markers to the element.

14. The sports target as recited in claim 12, wherein the target elements further comprise a first set of target elements at least partially extending into the opening, and a second set of target elements independent of the first set, wherein the second set extend into the opening to fully cover the opening.

15. The sports target as recited in claim 10, wherein the first and second shutters have beveled edges.

16. The sports target as recited in claim 10, wherein the first and second shutters have reinforced edges.

17. The sports target as recited in claim 10, further comprising a shock absorbent fascia member affixed to the first and second shutter proximate to the upper support member, the fascia member placed so as to receive an impact from the projectile hitting an upper portion of the target.

18. The sports target as recited in claim 10, further comprising means for relocating the target from a first position wherein it is used to another position for an alternate use.

19. The sports target as recited in claim 10, further comprising means for collecting the projectile once the projectile has passed through the opening.

20. A method for safely developing accuracy and technique in a player delivering a sports projectile to a preferred target location, the method comprising the steps of:

providing a frame having an upper support member and a base support member, separating the support members from a first slide rail and a second slide rail, thereby forming a frame opening with the slide rails and members;

movably supporting a first shutter in spaced relation to the upper support member in the direction of the player, forming a shield with the first shutter across the first slide rail;

movably supporting a second shutter in spaced relation to the upper support member in the direction of the player, forming a shield with the second shutter across the second slide rail;

supporting a first upper shutter in spaced relation to the upper support member in the direction of the player, forming a shield with the first upper shutter across the upper support member;

movably attaching a second upper shutter to the slide rails, the second upper shutter in spaced relation to the first upper shutter, communicating the second upper shutter with the first upper shutter for expanding a surface area formed by the upper shutters;

supporting a first lower shutter in spaced relation to the base support member in the direction of the player, forming a shield with the first lower shutter across the base support member; and movably attaching a second lower shutter to the slide rails, the second lower shutter in spaced relation to the first lower shutter, communicating the second lower shutter with the first lower shutter for expanding a surface area formed by the lower shutters, forming the upper and lower shutters and the first and second shutters together into an opening within the frame opening through which the trajectory can pass.

21. The method as recited in claim 20, further comprising the steps of:

movably supporting a multiplicity of first shutters in spaced relation to the frame in the direction of the player, forming at least one first shutter into a shield across a portion of the frame;

movably supporting a multiplicity of second shutters in spaced relation to the frame in the direction of the player, forming at least one second shutter into a shield across a portion of the frame;

supporting a multiplicity of second upper shutters by the frame, spacing each second upper shutter in relation to each other and to the first upper shutter; and supporting a multiplicity of second lower shutters by the frame, spacing each second lower shutter in relation to each other and to the first lower shutter, forming the multiplicity of shutters together into the opening through which the projectile can pass.

22. The method as recited in claim 20, further comprising the steps of:

providing a plurality of target elements;

rotatably affixing the target elements to the frame; and extending each element from the frame at least partially into the opening formed by the shutters.

23. The method as recited in claim 22, further comprising the step of removably affixing a target marker to the element.

24. The method as recited in claim 20, further comprising the step of providing means for collecting the projectile once the projectile has passed through the opening.

25. The method as recited in claim 20, further comprising the step of providing means for relocating the target from a first position to an alternate position.

26. A sports target useful in safely developing accuracy and technique in a player in delivering a projectile such as a baseball or hockey puck to a preferred location, the target comprising:

a frame;

a first shutter movably supported in spaced relation from the frame in a direction toward the player, the first shutter forming a shield across a first portion of the frame;

a second shutter movably supported in spaced relation from the frame in a direction toward the player, the second shutter forming a shield across a second portion of the frame;

an upper shutter supported in spaced relation from the frame in a direction toward the player, the upper shutter forming a shield across a third portion of the frame; and a lower shutter supported in spaced relation from the frame in a direction toward the player, the lower shutter forming a shield across a forth portion of the frame, wherein the shutters in combination totally shield the frame, the shutters hereby forming an opening through which the projectile can pass.

27. The sports target as recited in claim 26, further comprising:

a multiplicity of first shutters movable supported in spaced relation to the frame in a direction toward the player, at least one first shutter forming a shield across a first portion of the frame;

a multiplicity of second shutters movable supported in spaced relation to the frame in the direction of the player, at least one second shutter forming a shield across a second portion of the frame;

a multiplicity of upper shutters supported by the frame, each upper shutter in spaced relation to each other; and a multiplicity of lower shutters supported by the frame, each lower shutter in spaced relation to each other, wherein the multiplicity of shutters together from the opening through which the projectile can pass.

* * * * *